United States Patent [19]

Caporusso et al.

[11] 4,232,542

[45] Nov. 11, 1980

[54] PORTABLE MANUALLY CONTROLLED PIPE-BENDING APPARATUS PROVIDED WITH REVERSIBLE BENDING MEMBERS

[75] Inventors: Alessandro Caporusso; Mario Caporusso, both of Piedimonte S. Germano, Italy

[73] Assignee: C.M.L. Costruzioni Meccaniche Liri S.r.l., Piedimonte S. Germano, Italy

[21] Appl. No.: 25,453

[22] Filed: Mar. 29, 1979

[30] Foreign Application Priority Data

Apr. 6, 1978 [IT] Italy ..... 48765 A/78

[51] Int. Cl.[3] ..... B21D 7/06

[52] U.S. Cl. ..... 72/389; 72/453.16

[58] Field of Search ..... 72/389, 386, 453.01, 72/453.03, 316, 453.16

[56] References Cited

U.S. PATENT DOCUMENTS

| | | | |
|---|---|---|---|
| 2,867,261 | 1/1959 | Traupmann | 72/389 |
| 3,124,192 | 3/1964 | Williams | 72/389 |
| 3,848,450 | 11/1974 | Dehlbom | 72/389 |

FOREIGN PATENT DOCUMENTS

| | | | |
|---|---|---|---|
| 2306027 | 9/1975 | France | 72/389 |

*Primary Examiner*—Francis S. Husar
*Assistant Examiner*—Gene P. Crosby
*Attorney, Agent, or Firm*—Young & Thompson

[57] ABSTRACT

Portable manually-controlled hydraulic pipe-bending apparatus comprises a coupling head and reversible bending members to reverse the bending direction of a pipe relative to the apparatus. The coupling head has thereon two parallel pins for supporting the fixed bending member, and a piston stem that moves toward and away from the pins to support the movable member. The two arcuate bending members are provided with recesses to receive either the pins or the piston stem, thereby adapting them to reversible mounting for bending a tube in either of two opposite directions.

5 Claims, 10 Drawing Figures

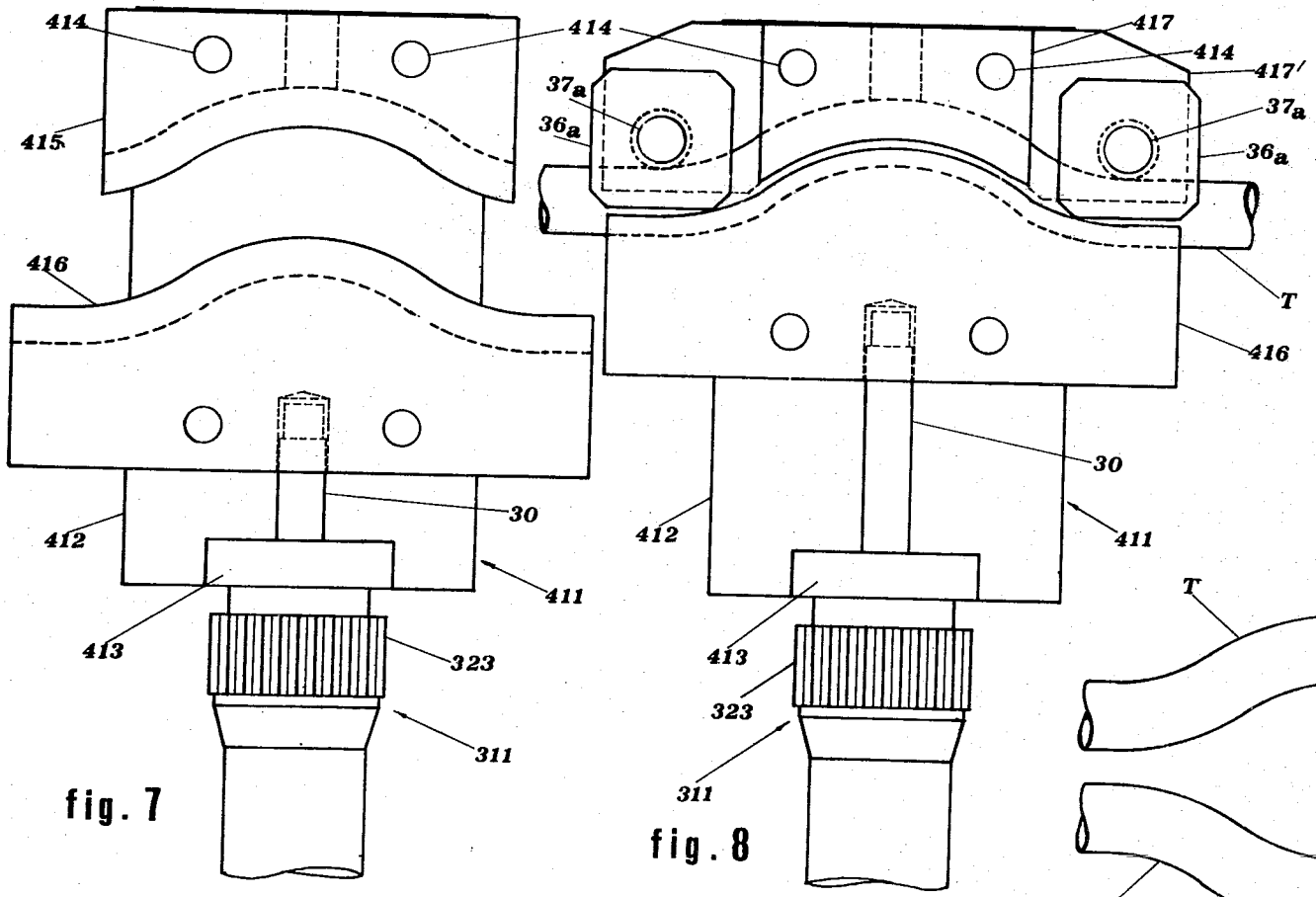
fig. 7
fig. 8
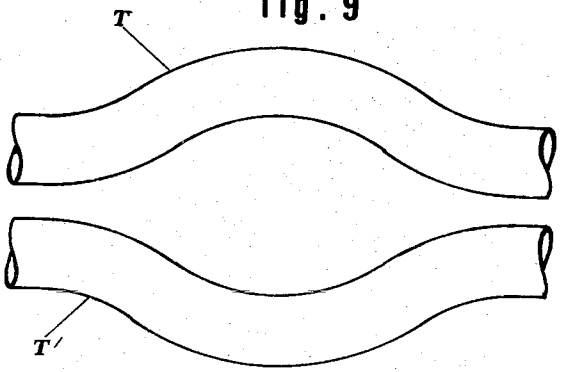
fig. 9
fig. 10

PORTABLE MANUALLY CONTROLLED PIPE-BENDING APPARATUS PROVIDED WITH REVERSIBLE BENDING MEMBERS

The present invention relates to pipe-bending apparatus, and particularly to a portable hydraulic pipe-bending apparatus to be controlled manually and operated in any desired position i.e. at a vertical or horizontal position or at any desired intermediate angle thereto. The apparatus is provided with a rotable coupling head and a supporting plate which is integral with one end of the main body of the apparatus, so that a fixed bending member and a movable bending member to be used for bending a pipe may be mounted thereon in reversible positions to progressively perform the bending of a pipe which is retained therebetween in corresponding reversed bending direction, although the position of the manually operated apparatus has been maintained.

Some embodiments of the recited portable hydraulic pipe-bending apparatus have already been described, illustrated and claimed in Italian U.S. Pat. Nos. 1,023,677 and 1.034,200, particularly as concerns the main body of same with valve and piston systems therein enclosed, the control lever as well as the fork section and pipe abutment members. An improved rotable coupling head to more favourably connect the main body to the bending section of the apparatus, is also known.

According to the present invention, further improvements relating to portable, manually operated, hydraulic pipe-bending apparatus have the aim to perform the pipe bending in opposite directions, by reversing the pipe-bending members and maintaining the operative position of the apparatus, as well as to vary the bending shape of the pipe, a gooseneck bending shape being preferred.

The first innovative modification concerns the reversibility of the bending members of the apparatus in order to perform the pipe bending in opposite directions by easily and quickly reversing the positions of the bending members. According to known embodiments, one of said bending members, namely the fork section of the apparatus, is generally integral with the main body, while the other, namely the arched member, is connected to the free end of the piston stem of the cylinder-piston unit, so that it is movable therewith when the apparatus is manually controlled.

These principles are substantially maintained, keeping however in mind the performance of said reversibility of bending members. To that purpose, in a preferred embodiment a supporting plate is provided which is integral with said main body and has two protruding pins in order to mount thereon the bending member to be considered as a fixed member, while the plate surface is provided as the sliding surface of the movable bending member, because this latter is connected to the free end of the piston stem, as said above.

A second innovative modification concerns the possibility of using in a quick and easy manner some bending members which are suitable to perform particular bending shapes, and specifically gooseneck bending shapes, said feature being related to the reversibility of bending members for changing the bending direction. Through many practical experiments in this field the Applicants have established that the operator may easily and quickly reverse the position of the bending members, so that more suitable bending shapes may be performed on site, as desired.

The main aim of the present invention is then to provide the body of a bending apparatus as in the cited references, with an integral supporting plate, on which may operate, in reversible positions, the two shaped bending members being used to perform the bending of a pipe which is retained therebetween, one of said bending members being placed in a fixed position on said supporting plate, while the other is sliding thereon when the apparatus is manually controlled by the operator, because of its connection to the free end of a piston stem of the apparatus.

Another aim of the present invention is to mount on said supporting plate the two bending members, namely an arched member having a peripheral concave groove and a fork section having a pair of pipe supporting members with a similar peripheral concave groove, the reversibility of these bending members being actually useful to easily and quickly perform the bending of a pipe in the one or the other direction, while maintaining the bending apparatus at the same operative position.

A further aim of the present invention is to mount and operate on said supporting plate, which is solid for the said main body of the bending apparatus, bending members the shape of which is proper to perform a gooseneck bending of a pipe to be bent, such a gooseneck, shape being characterized by straight lengths at both ends of the pipe bending; these bending members of the apparatus being so mounted that a reversibility of same is also possible in this case and a quick and easy pipe-bending in opposite directions may be performed.

Another aim of the present invention is to provide rotatable supports at both ends of one of these gooseneck pipe-bending members, the positions of said rotable supports being referred to said straight lengths of the gooseneck pipe-bending.

Those skilled in the art may easily understand that the possible interchangeability as well as the easy and quick reversibility of the bending members as provided in accordance with the present invention in order to perform a pipe-bending in a desired shape and direction, comprise a further improvement in pipe-bending apparatus as recalled above. The operator may operate more easily and quickly, keeping the apparatus in a single position and having the availability of the said rotable coupling head.

To better understand and illustrate the main and more important constructive and operative features of the present invention, some preferred embodiments of same will now be described, by way of examples, with reference to the accompanying drawings. It is however to be understood that the described and illustrated embodiments of the invention donot limit the possibility of further changes and modifications within the scope of the claims.

The description is made by selecting, as bending members of the portable, manually controlled, hydraulic pipe-bending apparatus, an arched member and fork section as known in this art, in which the fork section is provided with pipe abutment members liable to a roto-translating motion. to describe the embodiment specifically provided for a gooseneck pipe-bending in which an integral supporting plate is used, said pipe abutment members have been supposed as rotatable, grooved members in accordance with Italian Patent No. 1,023,677.

FIG. 7 shows a schematic front elevation of the plate which carries the bending members being mounted thereon in a fixed and sliding position, respectively, so that the bending members may perform a gooseneck bending of a pipe;

FIG. 8 shows a schematic front elevation of the plate which carries the bending members for the gooseneck bending of a pipe, in which the fixed member comprises rotatable pipe supporting members placed at the opposite ends of an intermediate support, these rotatable supporting members being provided with a proper groove to seat the pipe when a gooseneck bending is to be performed, the bent pipe being in its final position between said bending members at the end of the useful sliding motion of the movable bending member;

FIG. 9 shows a schematic front elevation of a portion of a gooseneck bent pipe according to a first direction of the bending shape as in FIG. 8;

FIG. 10 shows a schematic front elevation of a portion of gooseneck bent pipe according to a second, opposite direction in respect to FIG. 9, a reverse position having been assumed for the bending members mounted on the supporting plate of FIG. 8.

Figure 1:
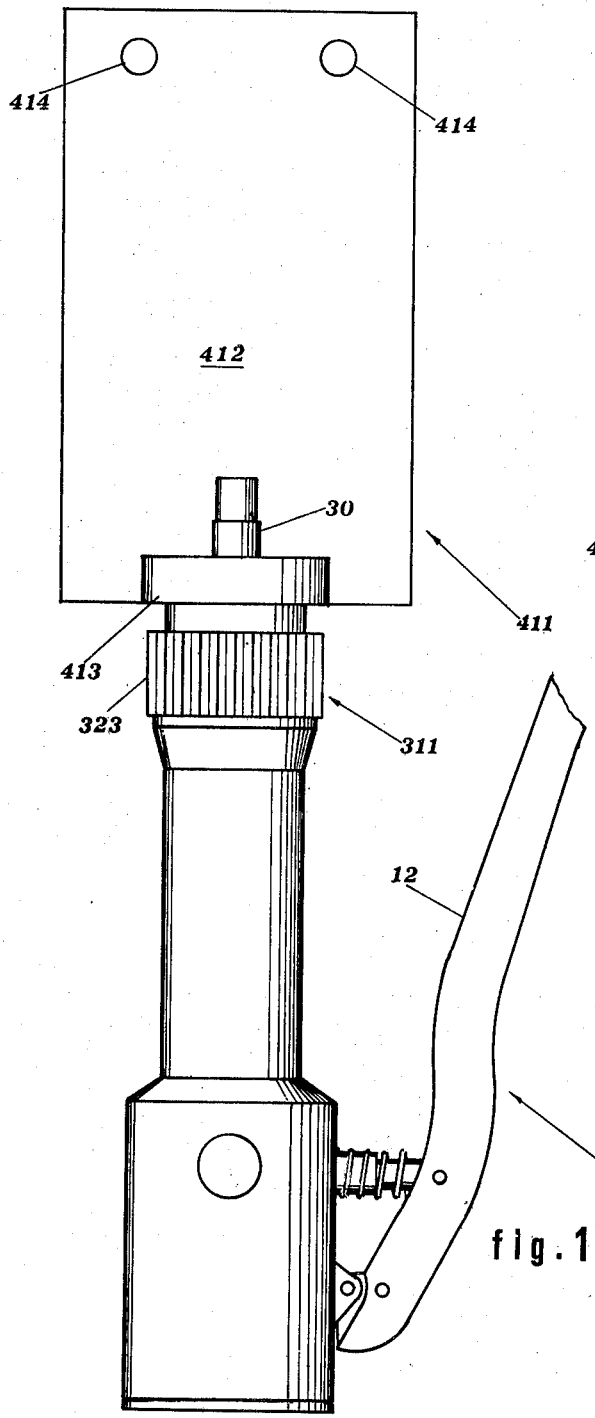
FIG. 1 shows a schematic front elevation of a portable, manually controlled, hydraulic pipe-bending apparatus which is provided with a known rotatable coupling head, and an integral supporting plate to support the bending members according to the present invention.
Figure 2:
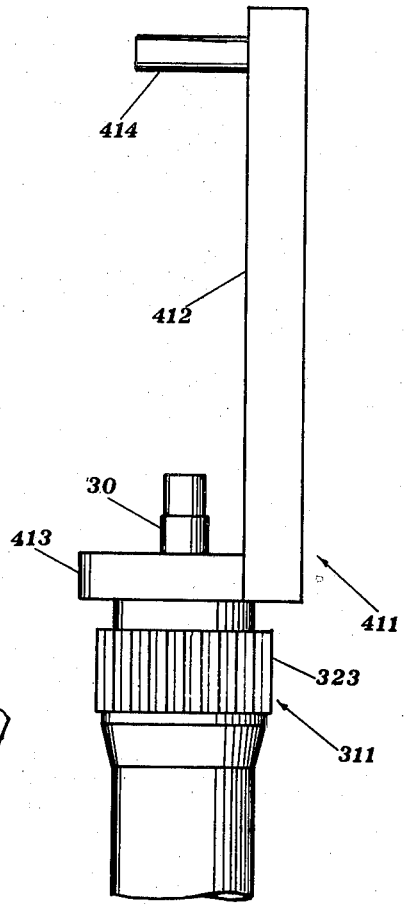
FIG. 2 shows a side elevation of FIG. 1 to evidence the connection of said plate to the main body of the apparatus, as well as the support function of same relating to a fixed bending member and a sliding bending member which are of a reversible type in order to perform the pipe bending in opposite directions, although the position of the portable apparatus is maintained.

Proceeding now to examine the accompanying drawings and first of all FIGS. 1 and 2, it is to be noted that the known body of bending apparatus 10, comprises at its free end a known integral coupling head 311 of a rotable type, with a knurled sleeve 323, as well as a supporting member 411 with plate 412 from which two parallel pins protrude, so that the one or the other of the bending members to be used for bending a pipe may be placed thereon in a fixed position, the remaining bending member being connected to the free end of piston stem 30 as a component member of the portable, manually controlled bending apparatus already specified in the above references. The planar surface of plate 412 forms the sliding surface of the movable bending member when this latter is shifted by manually controlling bending apparatus 10 and piston stem 30 is consequently moved.

Figure 4:
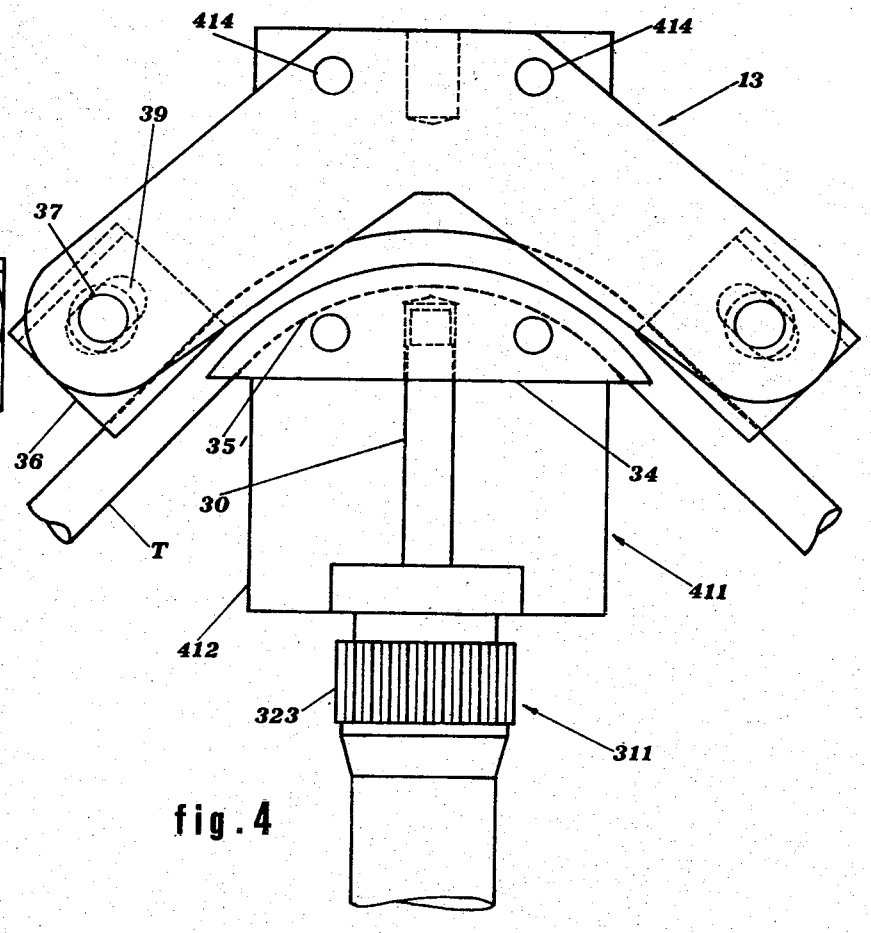
FIG. 4 shows a schematic front elevation similar to FIG. 3 in which the pipe has been bent in said first direction after the operator has manually controlled the apparatus to shift the sliding bending member thereof.
Figure 3:
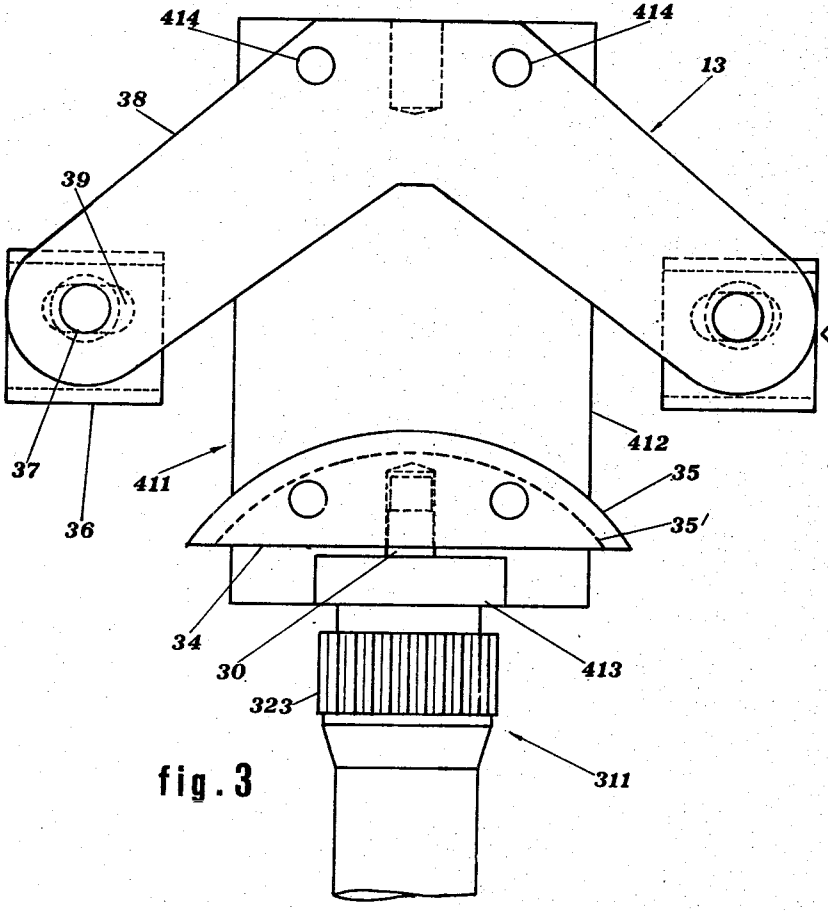
FIG. 3 shows a schematic front elevation of the plate which carries the bending members in its positions to perform a pipe-bending in a first direction.

According to FIGS. 3 and 4, in this embodiment the fixed member is fork section 13, the arms 38 of which are provided with roto-translating pipe abutment members 36. Members 36 are mounted on fixed pins 37 of the fork section and are sliding thereon because of its elongated groove 39 and contemporarily rotating about pins 37 during the bending action of the pipe. As noted in Italian patent No. 1,023,677, said members 36 are easily adaptable on outer surface of pipe T and follow the progressive changes of shape of same during a bending operation just because of the possibility of a roto-translating motion about pins 37. The influence of stretching stresses on pipe T is thus attenuated.

Figure 6:
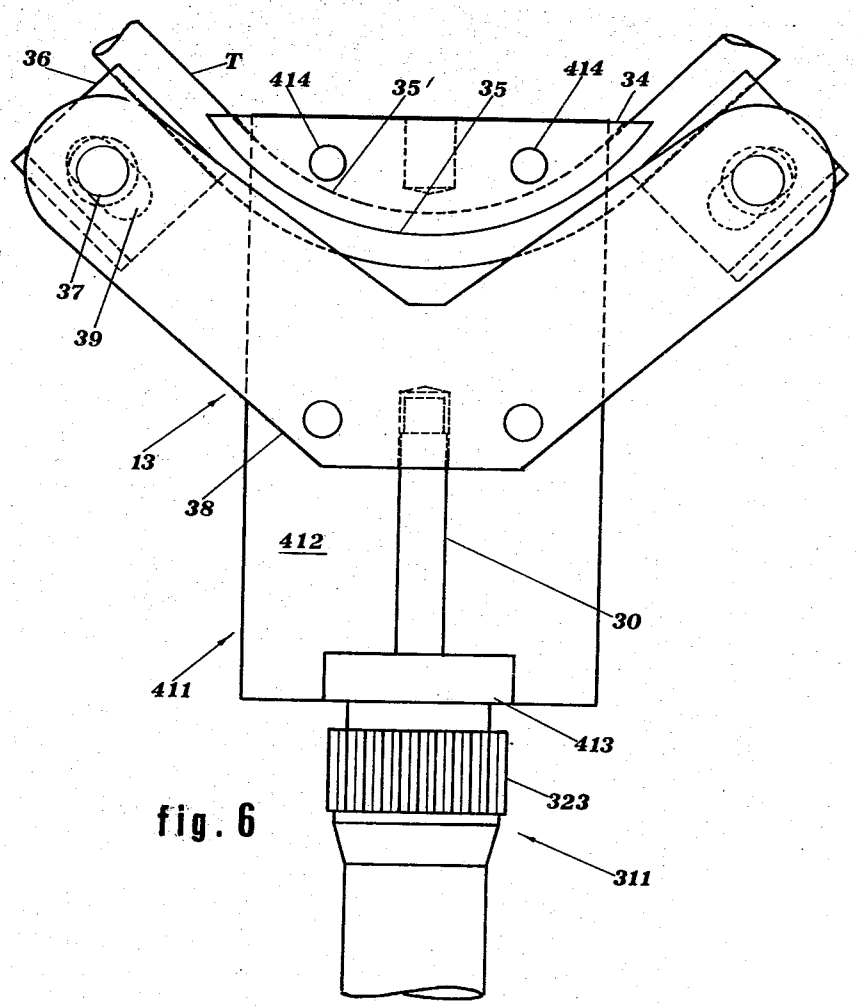
FIG. 6 shows a schematic front elevation similar to FIG. 5 in which the pipe has been bent in said second, opposite direction after the operator has manually controlled the apparatus to perform a pipe bending in said opposite direction in respect to FIG. 4.
Figure 5:
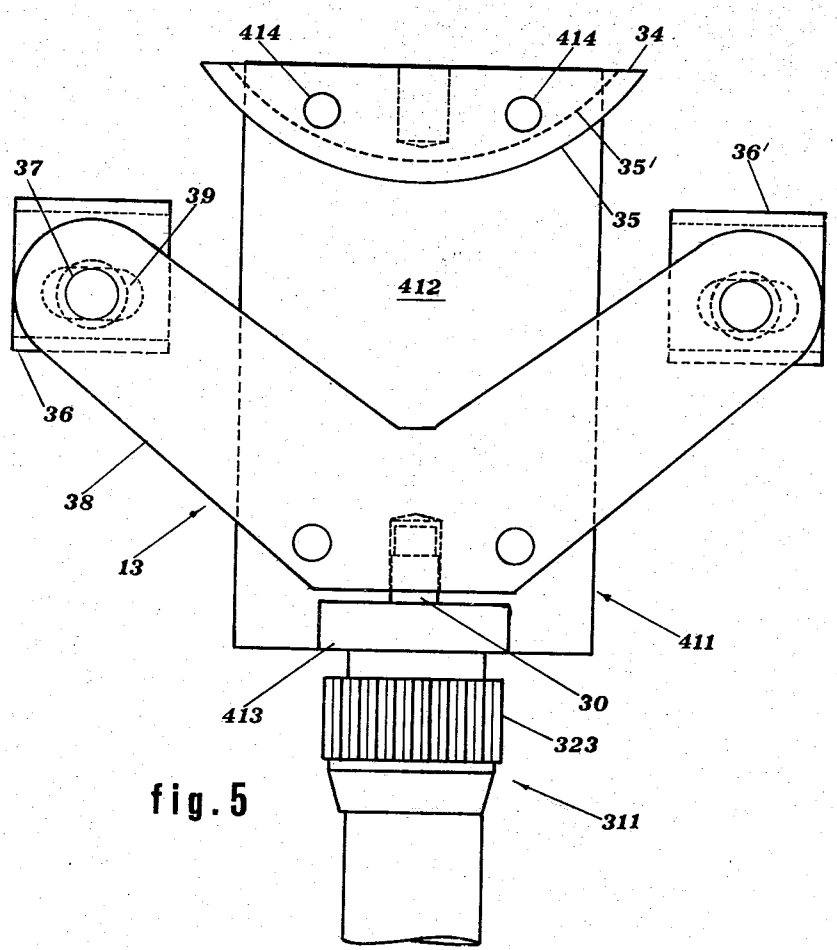
FIG. 5 shows a schematic front elevation of the supporting plate in which said bending members are placed in a reversed position in respect to FIG. 3.

From FIGS. 5 and 6 those skilled in the art may easily understand that a desired parallelism of pipe lengths which are including the bent pipe portion therebetween is possible by reversing the positions and functions of bending members 34 and 13, so that the former becomes now the fixed bending member which is monted on pins 414 of plate 412, while the latter, namely fork section 13, is the movable bending member which are acts on pipe T to be bent through its roto-translating members 36, the sliding motion thereof being due to its connection to piston stem 30 of the hydraulic device of apparatus 10. The reversed disposition of bending members 34, 13 may achieve parallelism of pipe lengths which are including the reversed bent portions of the pipe therebetween, as the arched shape of member 34.

It is anyhow evident that is possible and relatively easy to bend a pipe T in a direction which is opposite to the direction performed by using the disposition of bending members as shown in FIGS. 3 and 4, although the bending apparatus 10 with its rotable coupling head 311 remains in the same position. In this manner the operator has more favourable working conditions in different regions of the plant wherein the work is to be performed.

Referring now to FIGS. 7 and 8 it is possible to note that, when a supporting plate 412 is provided which is integral with the body of the apparatus and a rotable coupling head 311 is also used, some other bending members having different shape may be mounted in order to perform corresponding pipe-bendings. By reversing the disposition of said bending members it is again possible to perform bending shapes in the opposite direction.

FIGS. 7 and 8 slow apparatus to perform gooseneck bendings of a pipe T as shown in FIG. 9. FIG. 8 particularly shows the performance of a gooseneck bending of pipe T wherein the opposite pipe lengths which include said gooseneck bent portion of a pipe therebetween are assumed as coaxial, straight lengths.

According to the embodiment of FIG. 7, bending member 416 is provided with a groove to seat the pipe to be bent, which is longer than bending member 415, this latter being mounted on pins 414 of plate 412. In this case it is not necessary that the opposite side lengths which include the gooseneck bending therebetween, be coaxially straight. It is, on the contrary, possible that said side lengths which emerge from the opposite edges of bending member 415, may be slightly bent upwards, because of the bending stresses of the pipe.

The embodiment illustrated in FIG. 8 is still provided with said movable bending member 416. The fixed bending member is, on the contrary, provided in three pieces, namely: a central piece 417 like 415 and having a similar groove to seat the pipe to be bent with a gooseneck bending, this piece having side planar extensions, provided with pins 37*a;* two and side supports 36*a,* which are mounted on and freely rotable about said pins 37*a* and have a peripheral goove to seat the pipe during the bending operation. In this manner the opposite lengths of the pipe, which include the gooseneck bent portion of the same will assume a straight, coaxial state.

As said above in relation to embodiments illustrated in FIGS. 3, 4 and 5, 6, the bending members 415 and 416, as well as 417 and 416 are still reversible in this case, in order to perform a gooseneck bending of a pipe the direction of which is opposite to the former, as illustrated in FIG. 10.

In FIGS. 3, 4 and 5, 6 it is possible to note that, in order to easily reverse the positions of bending members to be used as fixed and movable bending members, said members are provided with transverse through-holes so that they may be mounted on pins 414 when the function of a fixed bending member is to be performed. A further longitudinal dead-hole is provided to allow the connection to the free end of piston stem 30 of hydraulic apparatus 10, when the function of a movable bending member is to be performed.

What we claim is:

1. A portable, manually controlled, hydraulic pipe-bending apparatus provided with a coupling head and reversible bending members to reverse the bending direction of a pipe relative to the apparatus, comprising the coupling head being (311) integral with a supporting member (411) made up of a plate (412) extending longitudinally of the apparatus, said plate having two parallel pins (414) which, in turn, support the bending member having the function of a fixed bending member, said pins (414) protruding from the surface of said supporting plate which is the sliding surface of a movable bending member, a piston stem actuated by a lever, said bending member being connected to the free end of said piston stem (30) of said apparatus and consequently moved therewith when operated by the operator by repeatedly actuating said lever (12), said fixed and movable bending members having the possibility of a reversible assembling on said pins (414) which are protruding from the plate (412) or on the end of said piston stem (30), respectively, in accordance with the desired bending direction of a pipe (T).

2. An apparatus as claimed in claim 1 in which both bending members having the function of a fixed and a movable member, respectively, are each one provided with transverse through-holes to be mounted on said protruding pins (414) as well as a longitudinal dead-hole in that side thereof which is to be connected to the free end of said piston stem (30).

3. An apparatus as claimed in claim 1 in which to perform a pipe-bending with its concave side towards the lever, the function of a fixed bending member is carried out by a fork section (13) each arm of which (38) is provided with a pin (37) to mount thereon a support (36) through an elongated opening (39), said support having also a straight groove to seat the pipe (T) during the bending operation thereof, so that said supports (36) may assume a roto-translating motion in order to follow the stresses of said pipe (T) during bending; said movable bending member being an arched member (34) which is connected to the free end of the piston stem (30) through a longitudinal deadhole, and provided with a peripheral groove (35') to seat a pipe (T) during pipe-bending.

4. A portable, manually controlled, hydraulic pipe-bending apparatus as claimed in claim 1 in which the function of a fixed bending member is carried out by a member (415) having a groove for supporting the pipe (T) to be bent, the shape of which matches that of an opposed bending member (416) so that a gooseneck pipe-bending may be performed, said members (415, 416) being mounted on said pins (414) of said plate (412) and the free end of said piston stem (30) with possibility of reversing its positions, in order to perform a gooseneck bending of said pipe (T,T') in first or second directions which are opposite to each other.

5. An apparatus as claimed in claim 5 in which the function of a fixed member and a movable bending member is performed in a reversible manner by said opposed bending member (416) and wherein said fixed member is replaced by another bending member (417), this latter having planar surfaces (417') at the opposite sides of a shaped central portion to perform the pipe-bending of a pipe (T,T'); rotatable grooved supports (36*a*) being mounted on fixed pins (37*a*) which are protruding from said planar surfaces (417') and operating as abutment members of a pipe (T,T') to be bent when the pipe is subjected to stresses during bending, so that said pipe (T,T') may be bent with a gooseneck shape and have the opposite ends of the bent portion in a coaxial alignment.

* * * * *